US011161719B2

(12) United States Patent
Oswald

(10) Patent No.: US 11,161,719 B2
(45) Date of Patent: Nov. 2, 2021

(54) SAFETY LOAD HOOK

(71) Applicant: pewag austria GmbH, Kapfenberg (AT)

(72) Inventor: Bernhard Oswald, Kapfenberg (AT)

(73) Assignee: pewag austria GmbH, Kapfenberg (AT)

( * ) Notice: Subject to any disclaimer, the term of this patent is extended or adjusted under 35 U.S.C. 154(b) by 97 days.

(21) Appl. No.: 16/786,876

(22) Filed: Feb. 10, 2020

(65) Prior Publication Data

US 2020/0255266 A1 Aug. 13, 2020

(30) Foreign Application Priority Data

Feb. 12, 2019 (DE) ..... 20 2019 100 795.8

(51) Int. Cl.
*B66C 1/36* (2006.01)
*B66C 1/40* (2006.01)

(52) U.S. Cl.
CPC . *B66C 1/36* (2013.01); *B66C 1/40* (2013.01)

(58) Field of Classification Search
CPC ..... B66C 1/36; B66C 1/40
See application file for complete search history.

(56) References Cited

U.S. PATENT DOCUMENTS 3,940,173 A 2/1976 Ulbing
5,193,480 A * 3/1993 Garrett ..... B66C 1/12 116/200
5,452,679 A * 9/1995 Eckley ..... F16G 15/06 116/200
2017/0341913 A1 11/2017 Inglis et al.

FOREIGN PATENT DOCUMENTS

DE 26 04 615 A1 8/1976
FR 2 409 956 A1 6/1979
WO WO 2016/079488 A1 5/2016

* cited by examiner

*Primary Examiner* — Dean J Kramer
(74) *Attorney, Agent, or Firm* — Christensen, Fonder, Dardi & Herbert PLLC

(57) ABSTRACT

A safety load hook with a lower part defining a curved hook mouth with a hook opening of a predefined nominal width. An upper part is attached to the lower part and is pivotable into an open position for insertion or removal of a load, and into a closed position blocking insertion of a load or removal of a load. A marking is on each of the end regions of the upper part and lower part which face one another in the closed state. When closed, and when a size of the hook opening corresponds to the nominal width, the lower part marking is offset from the upper part marking. The offset distance is chosen such that when there is a predefined maximum widening of the hook mouth in relation to the predefined nominal width thereof, both markings are located directly side by side in the closed state.

4 Claims, 2 Drawing Sheets

SAFETY LOAD HOOK

PRIORITY CLAIM

The present application claims priority to German Patent Application No. 20 2019 100 795.8, filed on Feb. 12, 2019, which said application is incorporated by reference in its entirety herein.

FIELD OF THE INVENTION

The invention relates to a safety load hook, including a lower part which realizes a curved hook mouth with a hook opening of a predefined nominal width and to which is attached an upper part which is pivotable into an open position, in which the hook opening is open for the insertion or removal of a load, and into a closed position, and which, in said closed position, blocks the hook opening to the outside such that the insertion of a load to be received into the hook mouth or the removal of a load contained there from said hook mouth is prevented.

BACKGROUND OF THE INVENTION

In the case of such safety load hooks it is certainly necessary to ensure a condition of use that is always safe within the framework of recurring inspections. An essential point, in this case, is the inspection of the deformation of the hook mouth which occurs, for example, in the event of overloads. Thus, for example, according to EN 818-6 and ÖNORM M9611, the admissible widening of the hook mouth as a result of overload is 10% of the nominal dimension thereof, which always has to be inspected within the framework of the recurring inspections.

A usual inspection method, in this case, consists in first of all determining the nominal width of the hook opening according to the manufacturer's specifications or with the help of a product catalogue and then measuring the hook opening actually present using a suitable measuring device. The widening of the hook mouth that has already occurred can be determined from the difference between the two obtained as a result, whereupon it is possible to decide whether the safety load hook has already reached the deformation limit and is to be withdrawn. In this connection, in addition to the measurement to be performed, there is also another corresponding computational task to be carried out in order to be able to make the final decision.

Safety load hooks have also already been made known in the market where forged wear markings have also been affixed in the hook lower part in the region of the hook mouth, to the left and the right of said hook mouth. In this case, an additional text is affixed here which establishes a maximum distance between said two markings. When the hook mouth widens and the specified maximum distance for the maximum admissible mouth opening is reached, the safety load hook has to be withdrawn. In this connection too, it is certainly necessary to carry out the measurement of the distance by means of a suitable measuring device in order to be able to establish the discard criteria of the hook.

In both above-mentioned cases, it is necessary at least always to be able to use a suitable measuring device in order to establish whether the hook in question is already excessively deformed or not.

SUMMARY OF THE INVENTION

Proceeding from here, the invention intends to provide an improvement in the realization of the hook in order to save both the measuring of a distance and also the time it takes to do so for the ongoing inspections and to be able to carry out an inspection in a purely visual manner.

This is achieved according to the invention with a safety load hook of the type named in the introduction in that a marking is respectively provided on each of the end regions of upper part and lower part which face one another when the upper part is in the closed state, wherein when the upper part is in the closed position, the marking on the lower part is offset from the marking on the upper part by a distance in the direction toward the hook opening, which distance is chosen such that when there is a predefined maximum widening of the hook mouth in relation to the predefined nominal width thereof, both markings are located directly side by side aligned with respect to one another when the upper part is in the closed state.

The wear indicators in the form of corresponding markings which are affixed in the case of the safety load hook according to the invention both on the hook upper part and also on the hook lower part, are present when the safety load hook is in the new state, that is to say when the hook opening thereof still comprises the predefined nominal width, such that, when the hook upper part is in the closed state, they are located offset from one another not in a line but at a distance from one another. However, when the hook mouth then widens in the course of use due to deformation, for instance as a result of overloading, the distance, when the upper part is in the closed state, by which the two markings are offset with respect to one another becomes smaller, wherein when a predefined size of widening is reached, the two markings are located directly side by side aligned with respect to one another. Consequently, when a safety inspection is carried out, the inspector is immediately able to recognize visually that the hook in question has reached the admissible deformation limit and must be withdrawn, when the admissible deformation limit is reached, that is to say when a predefined size of widening of the hook mouth occurs, the two markings are located directly side by side and, in this case, there is no longer a distance between them when viewed in the plane of the hook opening.

In order to be able to perform said inspection, the inspector needs neither the use of a suitable measuring device to determine the size of the opening of the hook mouth nor is any computational effort whatsoever necessary in this connection.

In addition, said visual inspection can also be carried out visually in an extraordinarily rapid manner and takes up almost no time whatsoever.

In the case of the safety load hook according to the invention, the wear markings can be provided or affixed on the upper part and on the lower part in any suitable form, it being particularly advantageous, however, to forge them respectively on the upper part and on the lower part directly during the production.

A particularly preferred realization of the wear markings also consists in that they are each realized in line form and, when they are located directly side by side, extend in a common line which visually verifies the reaching of the admissible deformation limit in an exceedingly rapid manner.

It is additionally advantageous when in the case of the invention the distance between each of the markings is chosen such that, when the upper part is in the closed position, when the hook mouth widens by 10% in relation to its predefined nominal width, said markings are located side by side because in the case of a widening by said amount, the discard criteria of the relevant safety load hook must normally be established in the ongoing inspection.

BRIEF DESCRIPTION OF THE DRAWINGS

The invention is explained in more detail below, in principle by way of example, by way of the drawings, in which:

FIGS. 3 and 4 each show an enlarged representation of detail A from FIG. 2, wherein FIG. 3 shows the case of the safety load hook from FIG. 2 in the new state and FIG. 4 shows when the deformation limit is reached in the case of a load hook according to FIG. 2.

DETAILED DESCRIPTION

Figure 1:
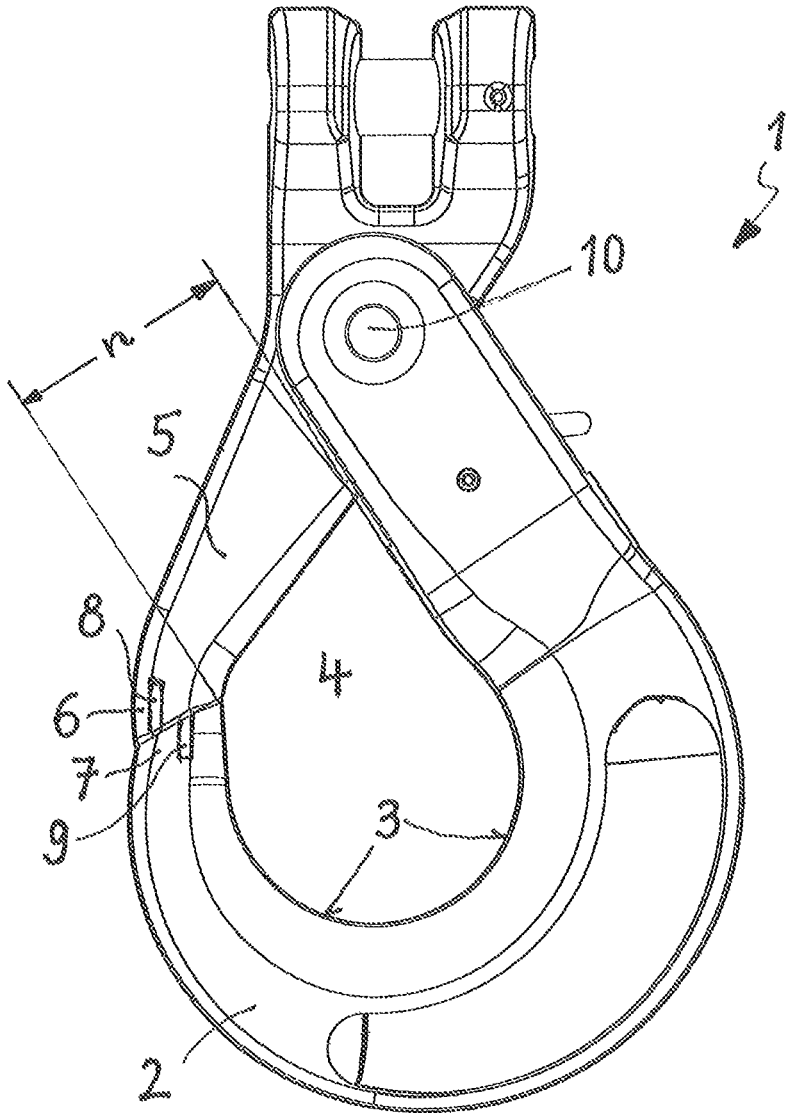
FIG. 1 shows a side view of a safety load hook according to the invention (in the closed position)

FIG. 1 shows a side view of a safety load hook 1 according to the invention which includes a fixed lower part 2 and an upper part 5 which is fastened to the lower part 2 so as to be pivotable about a pivot joint 10.

In this case, the upper part 5 is provided (at the top) with a suitable connection, for example with a coupling connection (as shown in FIG. 1) or also with an eyelet or a peg (not shown in the figures).

In this connection, the upper part 5 can be pivoted about the pivot joint 10 both into a closed position (FIG. 1) and into an open position (not shown) in which the upper part 5 is pivoted upwardly open about the pivot joint 10 relative to the lower part 2.

The lower part 2 forms a hook mouth 3 which determines a hook opening 4 at the top which comprises a predefined nominal width n in the new state.

As can be seen from FIG. 1, when the upper part 5 is in the closed state, the hook opening 4 is blocked toward the outside, whilst when the upper part 5 is in the open state, when it is pivoted upwardly open from the lower part 2, a load to be received (not shown) can be moved from outside through the hook opening 4 into the hook mouth 3 or can be removed again out of said hook mouth to the outside.

When the upper part 5 is in the closed state (FIG. 1), a marking is provided respectively, namely the marking 8 on the upper part 5 and the marking 9 on the lower part 2, at the end region 6 of the upper part 5 and at the end region 7 of the lower part 2, which face one another when the safety load hook 1 is in the closed state (it being possible for them to lie one on top of the other or also a small distance apart from one another, for instance up to 3 mm, with a corresponding minimum opening according to EN 818-6 being admissible). This is specified as detail A in the representation in FIG. 2, which only shows a lower portion of the view from FIG. 1, and is repeated, in an enlarged scale, for two different states in FIGS. 3 and 4 in each case in an enlarged scale.

Figure 2:
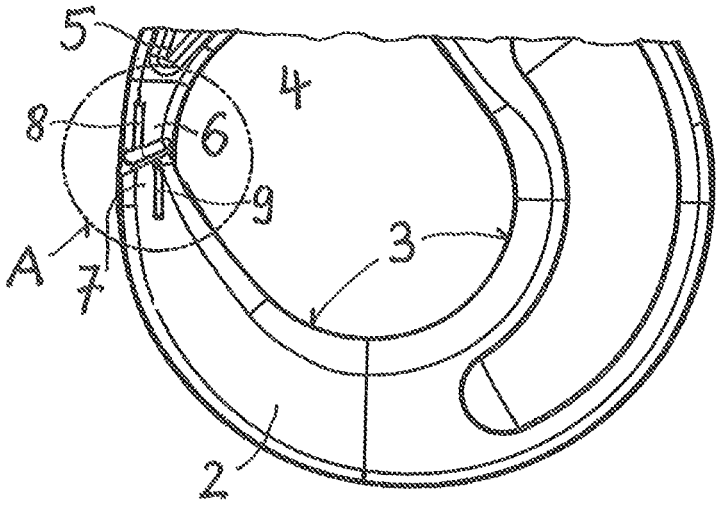
FIG. 2 shows a representation of the lower region of the safety load hook from FIG. 1 (in the closed state)
Figure 3:
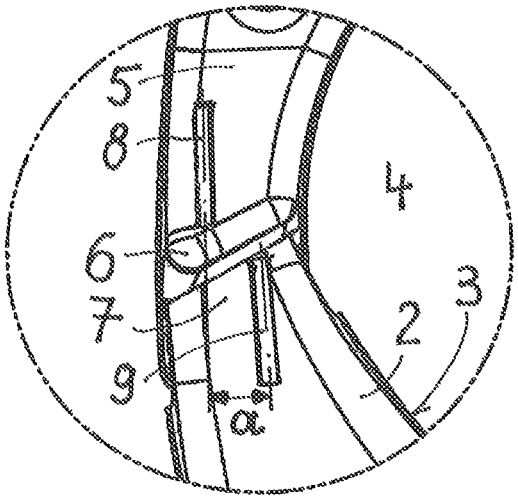

The representations in FIGS. 1 to 3 show a state where the hook opening 4 comprises the predefined nominal width n which is assigned to the relevant safety load hook 1, that is to say a state as corresponds to the new state of such a safety load hook 1. In this case, in the closed state, the end regions 6 and 7 of upper part 5 and lower part 2 are located aligned with respect to one another with their ends facing one another, as shown in detail in the representations in FIGS. 1, 2 and 3, reference being made expressly in this respect to the graphic representation in said figures.

In said state, which corresponds to the new state of the safety load hook 1, in which the lower part 2 and upper part 5 each have the design dimensions assigned to them and, in this case, the hook opening 4 comprises its assigned nominal width n, the wear markings 8 and 9 are affixed to the upper part 5 and lower part 2 in such a manner, as shown in FIG. 3 in an enlarged representation of the detail A from FIG. 2, that the wear marking 9 on the lower part 2 is offset in the direction toward the hook opening 4 by a distance a (cf. FIG. 3) relative to the wear marking 8 on the upper part 5.

In the case of the safety load hook 1, as a result of the loads held in the hook mouth 3, the hook mouth 3 is certainly deformed in an ongoing manner during the service life thereof, in particular in the event of overloads, in such a manner that said hook mouth widens. If, in this case, an admissible size of the widening of the hook mouth and consequently a corresponding deformation limit is reached, the safety load hook must not continue to be used and must be withdrawn. The admissible widening of the hook mouth 3 is defined in detail for such safety load hooks 1 by corresponding regulations or standards, wherein it corresponds, for example, to a widening of the hook mouth 3 by 10% in relation to the defined nominal width n thereof according to EN 818-6 and ÖNORM M9611.

Figure 4:
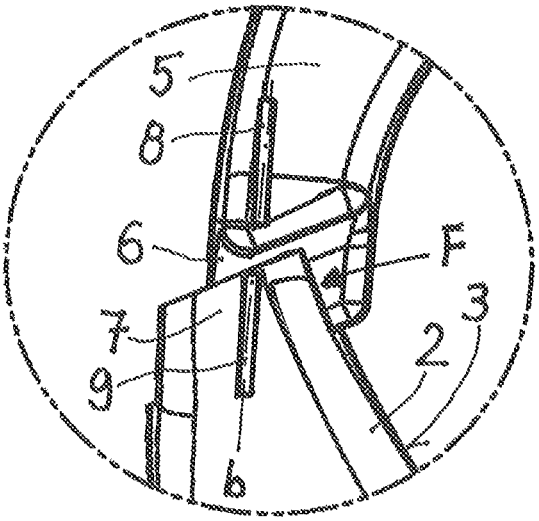

In the case of the widening of the hook mouth 3, the end region 7 thereof which faces the upper part 5 creeps outward in the direction toward the hook mouth 4, as is shown by the arrow F in FIG. 4. FIG. 4 shows, in this case, the detail A for the case where the deformation limit of the hook mouth 3 has been reached.

In the initial state of the safety load hook 1 shown in FIGS. 1 to 3, in the closed position thereof, that is to say corresponding to the new state thereof, the wear markings 8 and 9 are affixed in such a manner that the offset of the wear marking 9 on the lower part 2 relative to the wear marking 8 on the upper part 5 is chosen such that the distance between the two a is precisely of the size that the two wear markings 8 and 9 are located directly side by side (or perhaps better said: one above the other) when the maximum admissible widening of the hook mouth 3 is reached, as shown in FIG. 4.

The markings 8 and 9, in this case, are each realized, as shown in the figures, in a rectilinear line form and are provided in such a way on the upper part 5 or lower part 2 which carries them that they extend, when reaching the predefined maximum admissible widening of the hook mouth 3, as shown in FIG. 4, in a mutual alignment corresponding to a common line b.

In this way, it is very easily possible within the framework of an inspection of the widening of the hook mouth 3 of such a safety load hook 1 for the inspector to recognize immediately that the maximum admissible widening of the hook mouth 3 (and consequently also of the hook opening 4) has been reached because the markings 8 and 9 are then located directly aligned with respect to one another corresponding to the representation in FIG. 4.

Or expressed another way: As long as the marking 9 is still offset laterally in the direction toward the hook opening 4 or the hook mouth 3 relative to the marking 8, it can be immediately recognized visually that the admissible widening of the hook mouth 3 has not yet been reached.

The wear markings 8 and 9 can be provided respectively on the upper part 5 or lower part 2 in any suitable form, it being particularly favorable when the respective marking 8 or 9 is also forged on the upper part 5 or on the lower part 2 during the production thereof.

The invention claimed is:

1. A safety load hook, comprising:

a lower part defining a curved hook mouth with a hook opening of a predefined nominal width, and an upper part attached to the lower part, the upper part being pivotable into an open position in which the hook opening is open for insertion or removal of a load, and pivotable into a closed position in which the upper part blocks the hook opening toward an outside such that insertion of a load to be received into the hook mouth or removal of a load contained in the hook mouth from the hook mouth is prevented, wherein a marking is respectively provided on each of end regions of the upper part and the lower part, the markings facing one another when the upper part is in the closed position, wherein when the upper part is in the closed position, and when a size of the hook opening corresponds to the nominal width thereof, the marking on the lower part is offset from the marking on the upper part by a distance in a direction toward the hook opening, the distance being such that when there is a predefined maximum widening of the hook mouth in relation to the predefined nominal width thereof, both markings are located directly side by side when the upper part is in the closed state.

2. The safety load hook as claimed in claim 1, wherein the markings are forged respectively on the upper part and on the lower part.

3. The safety load hook as claimed in claim 1, wherein the markings are each realized in line form, and when the markings are located directly side by side, the markings extend in a common line.

4. The safety load hook as claimed in claim 1, wherein, when the upper part is in the closed position, a distance between each of the markings is such that the markings are located side by side when the hook mouth is widened by 10% in relation to its predefined nominal width.

* * * * *